US005820482A

United States Patent [19]

Sessions

[11] Patent Number: 5,820,482

[45] Date of Patent: Oct. 13, 1998

[54] GOLF PUTTER SHAFT ATTACHMENT

[75] Inventor: Sammy Glenn Sessions, San Marcus, Calif.

[73] Assignee: Acushnet Company, Fairhaven, Mass.

[21] Appl. No.: 640,052

[22] Filed: Apr. 30, 1996

[51] Int. Cl.[6] ..... A63B 53/02

[52] U.S. Cl. ..... 473/305; 473/312; 473/313

[58] Field of Search ..... 473/305, 306, 473/307, 308, 309, 310, 311, 312, 313, 314, 315, 324

[56] References Cited

U.S. PATENT DOCUMENTS

| | | | |
|---|---|---|---|
| 1,589,707 | 6/1926 | Kraeuter . | |
| 1,690,266 | 11/1928 | Barrett | 473/312 |
| 1,930,204 | 10/1933 | Judd | 473/309 |
| 2,146,321 | 2/1939 | Wettlaufer | 473/306 |
| 3,170,691 | 2/1965 | Pritchard | 473/306 |
| 3,394,745 | 7/1968 | Kuchins . | |
| 3,572,709 | 3/1971 | Risher | 473/308 |
| 3,640,534 | 2/1972 | Mills . | |
| 3,759,517 | 9/1973 | Mills . | |
| 4,832,340 | 5/1989 | Pickering . | |
| 5,039,098 | 8/1991 | Pelz . | |
| 5,042,806 | 8/1991 | Helmstetter . | |
| 5,137,275 | 8/1992 | Nelson | 473/306 |
| 5,275,409 | 1/1994 | Currie . | |
| 5,388,827 | 2/1995 | Reynolds | 473/306 |
| 5,439,218 | 8/1995 | Gondeck . | |
| 5,454,563 | 10/1995 | Nagamoto et al. . | |

FOREIGN PATENT DOCUMENTS

| | | | |
|---|---|---|---|
| WO8704634 | 8/1987 | WIPO | 273/80.2 |

*Primary Examiner*—Sebastiano Passaniti
*Attorney, Agent, or Firm*—Pennie & Edmonds L.L.P.

[57] ABSTRACT

The present invention is a putter comprising: a putter head having a striking face, a crown surface and a bore in the crown surface, a connection pin secured to the bore of the putter head through a mechanical connection, and a shaft adhered to the putter bore and the connection pin. Preferably, the bore is comprised of a first section and a second section and the shaft is adhered to the first section of the bore and the connection pin is secured to the second section of the bore.

19 Claims, 4 Drawing Sheets

GOLF PUTTER SHAFT ATTACHMENT

TECHNICAL FIELD OF THE INVENTION

The invention relates generally to a golf putter having a shaft-in-bore attachment. More particularly, the invention relates to a method of attaching a shaft to a putter head wherein the shaft is inserted into a bore in the putter head and adhered thereto.

BACKGROUND OF THE INVENTION

Golf putters with shaft-in-bore attachments are well known in the art. Most mallet putters are assembled using the shaft-in-bore attachment. As shown in FIG. 2, the putter head is provided with a bore hole for receiving a shaft. The shaft is inserted into the bore and adhered to the putter head, creating a bond between the outer surface of the shaft and the bore. However, this type of attachment does not provide a secure attachment.

SUMMARY OF THE INVENTION

It is an object of the present invention to provide a more secure attachment for the putter shaft to the putter bore in a shaft-in-bore attachment. It is also an objective of the present invention to provide a secure attachment between the shaft and the putter head that is inexpensive and easy to manufacture and assemble.

The present invention is a putter comprising: a putter head having a putter face, a crown surface and a bore in the crown surface, a connection pin secured to the bore of the putter head through a mechanical connection, and a shaft adhered to both the putter bore and the connection pin.

Preferably, the bore is comprised of a first section and a second section and the shaft is adhered to the first section of the bore and the connection pin is secured to the second section of the bore. The putter shaft end is tubular and has an inner diameter and an outer diameter. The first section of the bore preferably has a first diameter approximately the same as the outer diameter of the shaft. The diameter of the connection pin is approximately equal to the inner diameter of the shaft such that the shaft can be adhered thereto. It is also preferred that the connection pin has a length greater than the bore depth such that the connection pin extends from the putter head. Most preferably, the connection pin length is greater than two times the depth of the bore. Moreover, at least a portion of the connection pin that is adhered to the shaft is serrated for a strong bond.

In a first embodiment, the mechanical connection between the connection pin and the putter head is a threaded connection. In another embodiment, the putter is further comprised of a securement pin that extends through the putter head and the connection pin to form the mechanical connection. Preferably, the securement pin also extends through the shaft to provide a second mechanical connection between the shaft and the putter head. In another embodiment of the present invention, the mechanical connection is a press fit connection that is formed by swaging the connection pin into the bore. In yet still another embodiment, the connection pin is welded to the bore and the mechanical connection is the weld created thereby.

DESCRIPTION OF THE PREFERRED EMBODIMENT

Figure 1:
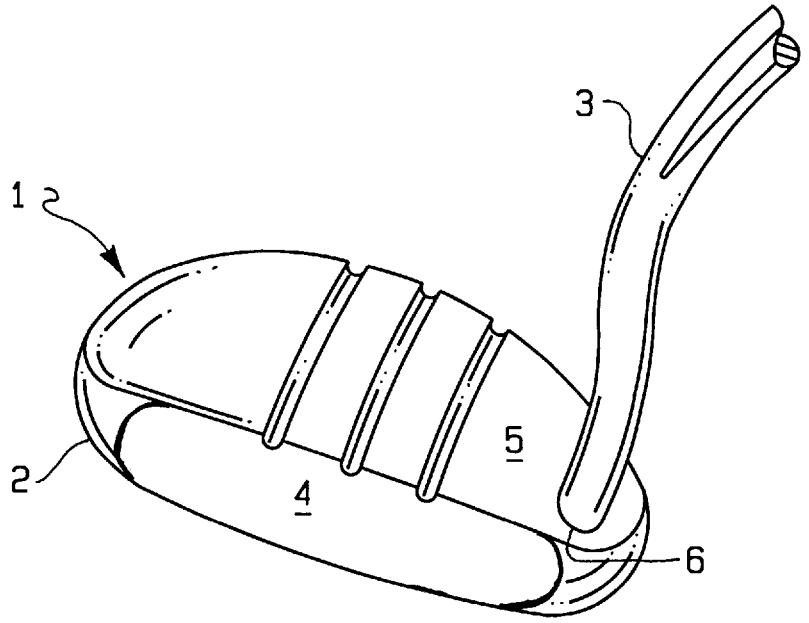
FIG. 1 is a perspective view of a golf putter head and shaft according to the present invention.

Referring to FIG. 1, a golf putter 1 according to the present invention includes a putter head 2, a shaft 3 and a grip (not shown). The putter head 2 is comprised of a putter face 4, a crown (or top) surface 5 and a bore 6 in the crown surface 5 for receiving the shaft 3. The shaft 3 is secured to the putter head 2 via an adhesive bond described in more detail below.

Figure 2:
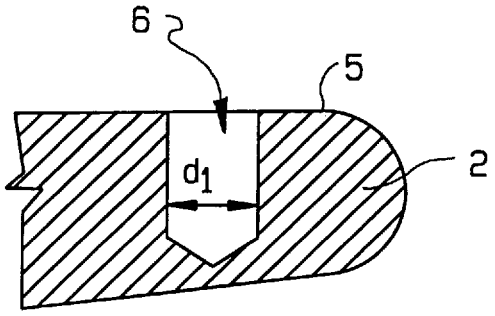
FIG. 2 (Prior Art)
FIG. 2 is a cross-section of a portion of a prior art putter head having a bore for receiving a shaft.
Figure 3:
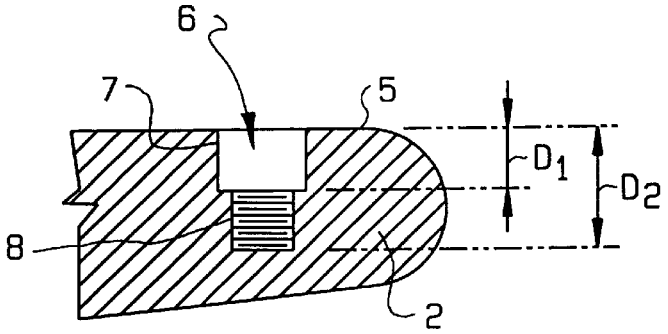
FIG. 3 is a cross-section of a portion of the putter head according to the present invention.
Figure 4:
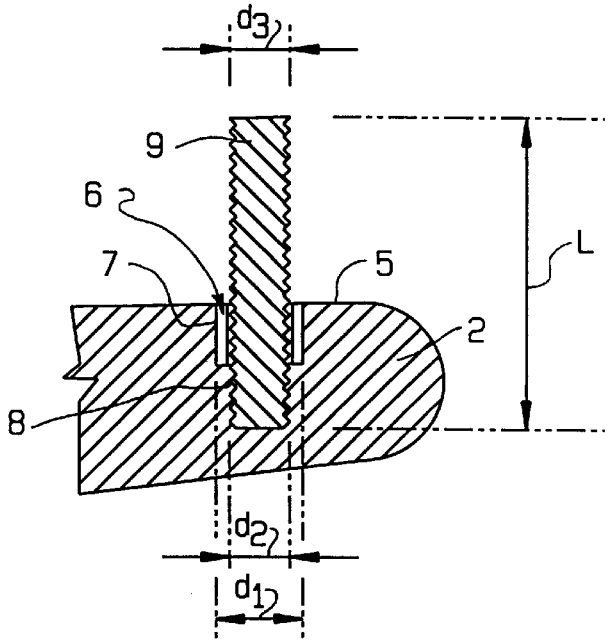
FIG. 4 is a cross-section of a portion of the putter head and connection pin according to the present invention.

Referring to FIG. 2, a cross section of a portion of a putter head 2 according to the prior art is shown. The prior art putter head 2 includes a crown surface 5 and a bore 6 in the crown surface 5. Typically, the bore 6 has a single diameter d1 which is substantially the same as the outside diameter of the putter shaft, i.e., the typical bore 6 is drilled to have a diameter d1 equal to 0.36 inches for a putter shaft having an outer diameter of about 0.36 inches. The shaft 3 is typically tip ground to reduce the outside diameter by about 0.005 inches and to roughen up the bonding surface. To bond the shaft 3 to the putter head 2, an adhesive, such as epoxy, is placed inside the bore 6 and the shaft is inserted therein such that the outer surface of the shaft 3 is adhered to the bore 6. Thus, the bond strength is dependent upon the adhesive strength and the bonding area.

Referring now to FIGS. 3–6, the putter 1 of the present invention is comprised of a putter head 2 which includes a bore 6 having two sections 7 and 8. The first section 7 has a diameter d1 which is substantially the same as the outer diameter OD of the shaft 3, generally about 0.36 inches, and extends into the putter head 2 from the crown surface 5 to a depth of D1. The second section 8 of bore 6 has a diameter d2 which is less than d1 and extends further into the putter head from the bottom end of the first section 7 to a depth D2 from the crown surface 5. The diameter of the second section d2 is approximately equal to or less than the inner diameter ID of the putter shaft 3. For a putter shaft 3 having an inner diameter ID of 0.28 inches, the second portion 8 has a diameter d2 of about 0.25 inches.

The putter 1 is further comprised of a connection pin 9. The connection pin 9 is a member having an outer diameter d3 that is substantially the same as the second bore section diameter d2 and slightly less than the inner diameter ID of the putter shaft 3. For a shaft 3 having an ID equal to about 0.28 inches, the connection pin 9 has an outer diameter d3 of 0.25 inches. The connection pin 9 is preferably made of steel or aluminum for strength, but can be made of a high strength plastic for reduced weight.

The connection pin 9 is inserted into the second section 8 of bore 6 and secured thereto by a mechanical connection 11. Preferably, the connection pin 9 is a screw having serrations 10, the second bore section 8 is threaded and the mechanical connection 11 between the connection pin 9 and the second bore section 8 is a threaded connection. Since the mechanical connection 11 is substantially stronger than an adhesive bond, the force required to pull the connection pin 9 from the bore 6 is substantially greater than for an adhesive bond. Epoxy is preferably poured into the second bore section 8 before the connection pin 9 is threaded therein so that the threaded connection does not loosen with time and vibration.

As stated above, the second section 8 of the bore extends from the bottom of the first section 7 to a depth D2 from the top of the crown surface 5. The connection pin 9 has a length L that is greater than the depth D2 such that the connection pin 9 extends from the bore 6. Preferably, the length L is greater than twice the depth D2. More preferably, the depth D2 is about 0.5 inches and the connection pin is at least 1 inch long. Thus, the connection pin 9 extends from the top of the putter head 2 and provides substantially more surface for the shaft 3 to attach to.

Figure 5:
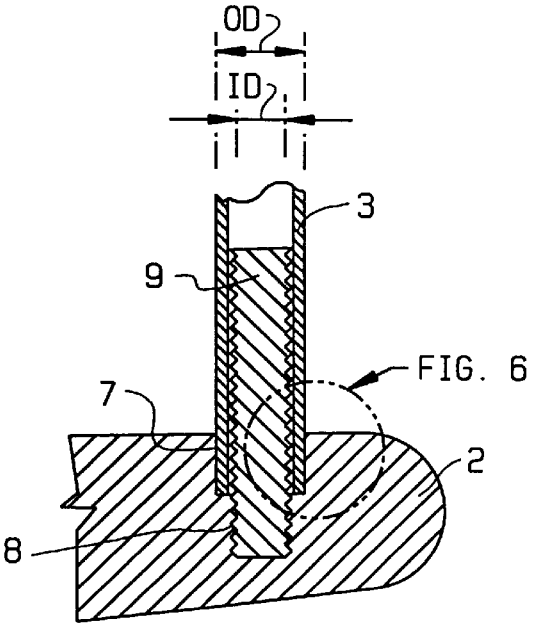
FIG. 5 is a cross-section of a portion of the putter head, connection pin and putter shaft according to the present invention.
Figure 6:
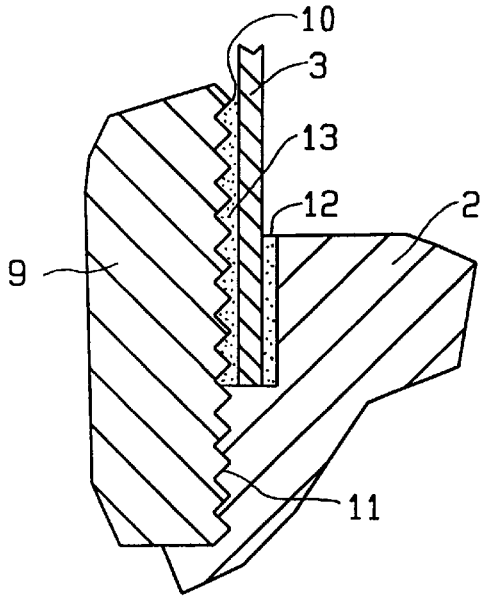
FIG. 6 is an enlargement of the circled portion of the putter head, connection pin and putter shaft in FIG. 5.

Referring to FIGS. 5 and 6, the shaft 3 is shown inside the first bore section 7 and circumscribed around a portion of the connection pin 9. The shaft 3 is bonded, preferably with an epoxy, to both the bore 6 and the connection pin 9. FIG. 6 shows the adhesive bond 12 between the outer surface of the shaft 3 and the inner surface of the bore 6 and the adhesive bond 13 between the inner surface of the shaft 3 and the outer surface of the connection pin 9. As stated above, the connection pin 9 preferably is a screw having serrations 10. This creates a strong mechanical connection 11 with the putter head 2 and substantially increases the strength of the adhesive bond 13 between the connection pin 9 and the shaft 3. Since the connection pin 9 is mechanically secured to the putter head 2, the force required to separate the shaft 3 from the putter head 2 is substantially increased.

Figure 7:
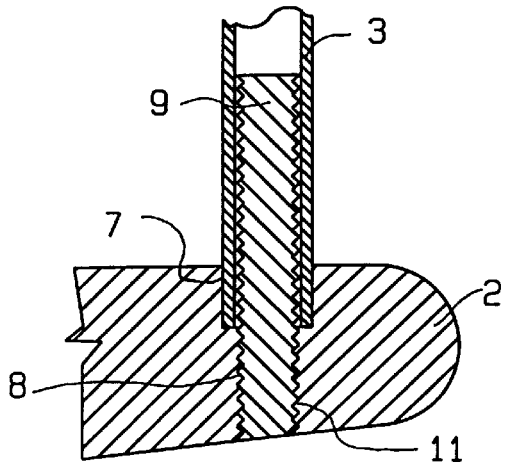
FIG. 7 is a cross-section of a portion of the putter head, connection pin and putter shaft of a second embodiment of the present invention.

FIG. 7 shows a second embodiment of a putter 1 according to the present invention that is very similar to the embodiment shown in FIGS. 3–6. The shaft 3 is adhered to both the putter head 2 and the connection pin 9. In this embodiment, however, the second portion 8 of the bore 6 extends through the putter head 2 to the sole 17. The mechanical connection 11 between the putter head 2 and the connection pin 9 is thus increased due to the increase in the threaded connection.

Figure 8:
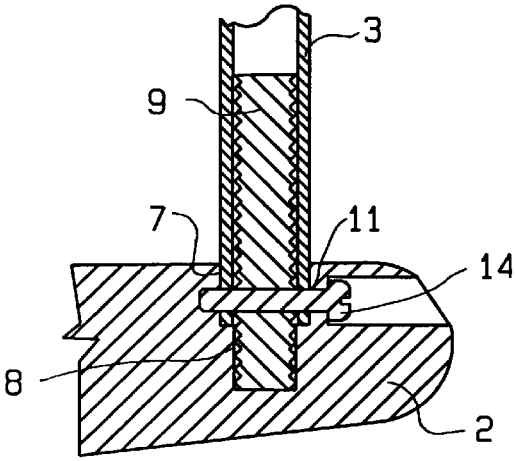
FIG. 8 is a cross-section of a portion of the putter head, connection pin and putter shaft of a third embodiment of the present invention.

Referring to FIG. 8, another embodiment of the present invention is shown wherein the connection pin 9 is secured to the putter head 2 via a securement pin 14. The securement pin 14 is preferably threaded into the putter head perpendicular to the connection pin 9 from either the putter face 4 or the back of the putter head 2 as shown. Preferably, the securement pin 14 is threaded through both the connection pin 9 and the shaft 3. Thus, a second mechanical connection is created between the shaft 3 and the putter head 2.

Figure 9:
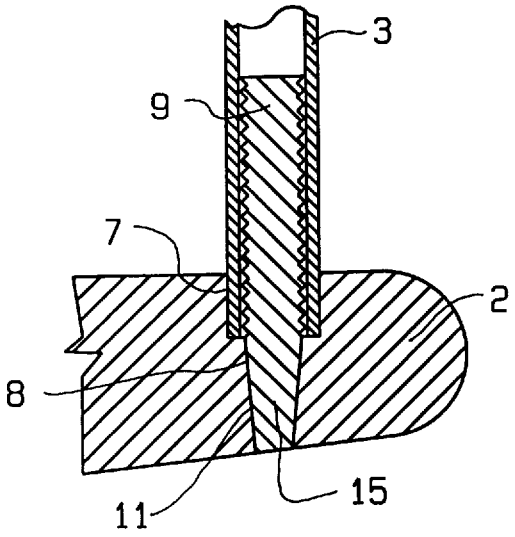
FIG. 9 is a cross-section of a portion of the putter head, connection pin and putter shaft of a fourth embodiment of the present invention.
Figure 10:
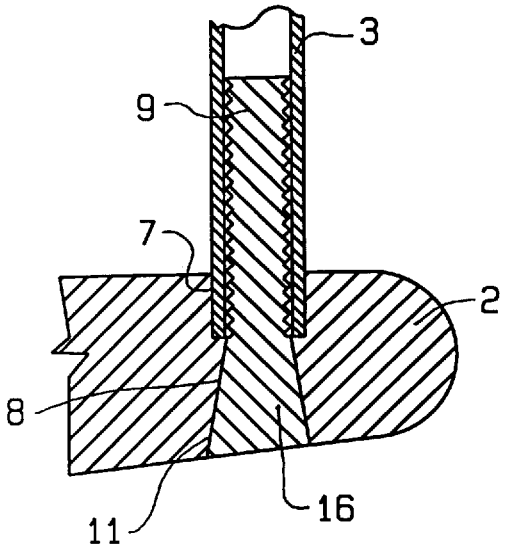
FIG. 10 is a cross-section of a portion of the putter head, connection pin and putter shaft of a fifth embodiment of the present invention.

In FIGS. 9 and 10 alternate embodiments of the present invention are shown wherein the connection pin 9 is secured to the putter head 2 through a press fit mechanical connection 11. The connection pin 9 is swaged into the second portion 8 of the bore 6 to provide a secure press fit. In FIG. 9, the connection pin 9 has a tapered end 15 for fitting into the second section of the bore 8 which has a corresponding configuration. The tapered end 15 decreases in diameter from a diameter that is substantially equal to the inner diameter of the shaft as it extends further into the putter. In this embodiment, the connection pin 9 is swaged into the putter head 2 from the crown surface 5. In FIG. 10, the connection pin 9 has a conical end 16 that increases in diameter from a diameter substantially equal to the inner diameter of the putter shaft as it extends further into the putter. In this embodiment, the connection pin 9 is inserted through the sole 17 and swaged into the putter head 2. In both of these embodiments, the connection pin 9 has a press fit mechanical connection 11 between the tapered end 15 or conical end 16 and the second section 8 of the bore 6.

Figure 11:
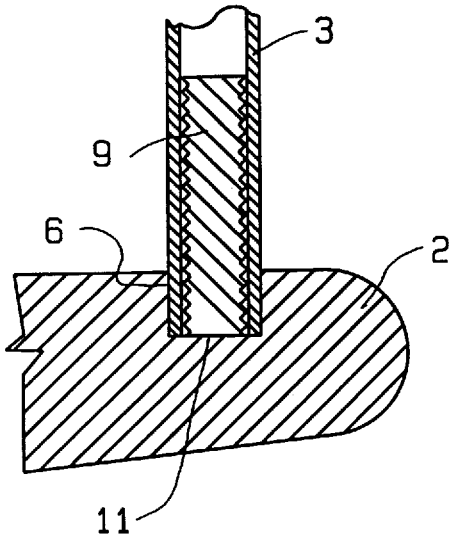
FIG. 11 is a cross-section of a portion of the putter head, connection pin and putter shaft of a sixth embodiment of the present invention.

Still yet another embodiment of the putter 1 according to the invention is shown in FIG. 11. In this embodiment, the mechanical connection 11 between the connection pin 9 and the putter head 2 is a weld, i.e., the connection pin 9 is welded to the bottom surface of the bore 6.

While it is apparent that the invention herein disclosed is well calculated to fulfill the objectives stated above, it will be appreciated that numerous modifications and embodiments may be devised by those skilled in the art and it is intended that the appended claims cover such modifications and embodiments as fall within the spirit and scope of the present invention.

I claim:

1. A putter comprising:

a. a putter head having a putter face, a crown surface and a bore in the crown surface;

b. a connection pin being a screw that is threaded to the bore of the putter head; and c. a shaft having an end received in the bore and adhesively secured to the connection pin and the bore to create an adhesive bond between the shaft and the connection pin and between the shaft and the bore;

wherein the connection pin includes means for increasing the adhesive bond between the connection pin and the shaft.

2. The putter of claim 1 wherein the bore has a depth from the crown surface and the connection pin has a length greater than the bore depth such that the connection pin extends from the bore.

3. The putter of claim 1 wherein at least a portion of the connection pin that is adhered to the shaft is serrated.

4. The putter of claim 1 wherein the bore is comprised of a first section and a second section and the shaft is adhered to the first section of the bore and the connection pin is secured to the second section of the bore.

5. The putter of claim 4 wherein the first section of the bore extends into the putter head from the crown surface to a bottom end and the second section extends into the putter head from the bottom end of the first section.

6. The putter of claim 5 wherein the shaft has an inner diameter and an outer diameter and the first section of the bore has a first diameter approximately the same as the outer diameter of the shaft.

7. The putter of claim 6 wherein the second section of the bore has a second diameter and the connection pin has a third diameter and the second diameter and the third diameter are approximately equal to the inner diameter of the shaft so that the shaft can be adhesively secured to the connection pin.

8. The putter of claim 1 wherein the putter further comprises a securement pin that extends through the putter head and the connection pin to form the mechanical connection.

9. The putter of claim 8 wherein the securement pin also extends through the shaft to provide a second mechanical connection between the shaft and the putter head.

10. The putter of claim 1 wherein the means for increasing the bond between the connection pin and the shaft includes a plurality of serrations on an outer surface of the connection pin.

11. A putter comprising:

a. a putter head having a putter face, a crown surface and a bore in the crown surface having a depth from the crown surface;

b. a connection pin being a screw that is threaded to the bore of the putter head and having a length; and c. a shaft having an end received in the bore and adhesively secured to the connection pin and the bore;

wherein the connection pin is greater than two times the bore depth.

12. A putter comprising:

a. a putter head having a putter face, a crown surface and a bore in the crown surface having a bottom surface in the putter head;

b. a connection pin secured to the bore of the putter head through a mechanical connection to extend from the bottom surface; and c. a shaft adhesively secured to the bore and to the connection pin d. wherein the connection pin includes means for increasing the adhesive bond between the connection pin and the shaft.

13. The putter of claim 12 wherein the bore has a depth from the crown surface and the connection pin has a length greater than the bore depth such that the connection pin extends from the bore.

14. The putter of claim 12 wherein the shaft has an inner surface secured to the connection pin and an outer surface secured to the bore.

15. The putter of claim 12 wherein the means for increasing the bond between the connection pin and the shaft includes a plurality of serrations on an outer surface of the connection pin.

16. A putter comprising:

a. a putter head having a putter face, a crown surface and a bore in the crown surface having a bottom surface in the putter head and a bore depth;

b. a connection pin secured to the bore of the putter head through a mechanical connection to extend from the bottom surface and having a length; and c. a shaft adhesively secured to the bore and to the connection pin;

d. wherein the connection pin length is greater than two times the bore depth.

17. A putter comprising:

a. a putter head having a putter face, a crown surface and a bore in the crown surface;

b. a connection pin secured to the bore of the putter head through a mechanical connection; and c. a shaft having an end received in the bore and adhesively secured to at least the connection pin;

wherein the bore is comprised of a first section which extends into the putter head from the crown surface to a bottom end and a second section which extends into the putter head from the bottom end of the first section and the shaft is adhered to the first section of the bore and the connection pin is secured to the second section of the bore; and wherein the shaft has an inner diameter and an outer diameter and the first section of the bore has a first diameter approximately the same as the outer diameter of the shaft and the second section of the bore has a second diameter and the connection pin has a third diameter and the second diameter and the third diameter are approximately equal to the inner diameter of the shaft so that the shaft can be adhesively secured to the connection pin.

18. A putter comprising:

a. a putter head having a putter face, a crown surface and a bore in the crown surface;

b. a connection pin which includes a tapered end that is swaged into the bore from the crown surface to create the press fit mechanical connection with the bore of the putter head mechanical connection; and c. a shaft having an end received in the bore and adhesively secured to the connection pin and the bore.

19. A putter comprising:

a. a putter head having a putter face, a crown surface and a bore in the crown surface;

b. a connection pin is welded to the bore of the putter head; and c. a shaft having an end received in the bore and adhesively secured to the connection pin and the bore;

wherein the connection pin includes means for increasing the adhesive bond between the connection pin and the shaft.

* * * * *